US005394668A

United States Patent [19]

Lim

[11] Patent Number: 5,394,668

[45] Date of Patent: Mar. 7, 1995

[54] PANEL EXTENSION ASSEMBLY

[75] Inventor: Bin H. Lim, Holland, Mich.

[73] Assignee: Herman Miller, Inc., Zeeland, Mich.

[21] Appl. No.: 17,644

[22] Filed: Feb. 12, 1993

[51] Int. Cl.[6] ..... E04B 1/38; E04B 2/74

[52] U.S. Cl. ..... 52/483.1; 52/239; 52/266; 52/271; 52/592.6; 52/582.1; 52/637

[58] Field of Search ..... 52/239, 702, 704, 708, 52/712, 578, 582.1, 588.1, 592.6, 266, 271, 637, 745.03, 483.1, 474; 403/232.1, 234

[56] References Cited

U.S. PATENT DOCUMENTS

| | | | |
|---|---|---|---|
| Re. 32,890 | 3/1989 | DeFouw et al. | 52/239 |
| 1,879,848 | 9/1932 | Horne . | |
| 1,931,739 | 10/1933 | Rotten | 52/266 |
| 2,115,625 | 4/1938 | Fleshman . | |
| 2,611,160 | 9/1952 | Hanesse . | |
| 2,729,411 | 1/1956 | Cahill . | |
| 3,180,459 | 4/1965 | Liskey, Jr. | 52/239 |
| 3,618,675 | 11/1971 | Hornung . | |
| 3,907,445 | 9/1975 | Wendt . | |
| 3,989,398 | 11/1976 | Wendt | 403/232.1 X |
| 4,042,200 | 8/1977 | Overall . | |
| 4,366,910 | 1/1983 | Uccello et al. . | |
| 4,410,158 | 10/1983 | Maffei . | |
| 4,478,019 | 10/1984 | Thompson, Jr. | 52/239 |
| 4,607,422 | 8/1986 | Scaramucci . | |
| 4,611,948 | 9/1986 | Johnson . | |
| 4,692,056 | 9/1987 | Alperson . | |
| 4,765,111 | 8/1988 | Osawa . | |
| 4,932,173 | 6/1990 | Commins . | |
| 5,092,097 | 3/1992 | Young | 52/702 |
| 5,104,252 | 4/1992 | Colonias et al. | 52/702 X |
| 5,109,646 | 5/1992 | Colonias et al. | 52/712 |

FOREIGN PATENT DOCUMENTS

| | | |
|---|---|---|
| 1068579 | 5/1967 | United Kingdom . |

*Primary Examiner*—Carl D. Friedman
*Assistant Examiner*—Robert J. Canfield
*Attorney, Agent, or Firm*—Willian Brinks Hofer Gilson & Lione

[57] ABSTRACT

The present invention is directed to a panel extension assembly for supporting an extension wall panel on top of a base wall panel. The panel extension has a channel member adapted to receive a substantially horizontally extending top surface of a base wall panel frame. The channel member has a pair of spaced side walls joined by a middle wall and is adapted to slide over the sides and rest on the top surface of the base wall panel frame. An extension member is attached to the channel member and extends upward therefrom. An extension wall panel is attached to the extension member thereby securing the extension wall panel on top of the base wall panel.

15 Claims, 3 Drawing Sheets

PANEL EXTENSION ASSEMBLY

BACKGROUND OF THE INVENTION

The present invention relates generally to wall panel systems. More particularly, the invention relates to a panel extension assembly that allows for a previously constructed wall panel to have an additional wall panel stacked on top thereby increasing the height of the wall.

In many businesses, work areas must be constructed in different sizes and shapes within a building with integral interior and outer walls. When permanent rigid walls are used it is a relatively expensive and difficult task to change or relocate walls. Accordingly, modular vertical wall panel systems are often used to divide an enclosed space into separate work areas. These work areas are often constructed using panels of a standard size. For example, an office may use a standard panel system that has a height of 36 inches. Wall panel systems constructed with 36 inch wall panels are particularly useful in creating secretarial stations, and the like. While, taller wall panel systems create a more private work area such as that required in telephone sales. However, if a business desired to switch between an original shorter panel system and a larger wall panel system, it would have to completely remove the original wall panel system and replace it with taller vertical panels.

While vertically adjustable wall panel systems are known, these systems only provide a very limited range of motion in order to facilitate installation and movement of the panels. In addition, a base cover is necessary to provide privacy in the work area when the panel is adjusted vertically upward. For example, U.S. Pat. No. 4,407,101 (Propst) discloses a vertically adjustable wall panel. An adjustment bolt connects one end of the wall panel to a foot assembly. The adjustment bolt is externally threaded in opposite directions so that when the bolt is turned, the wall panel moves vertically relative to the foot assembly. In order to conceal the adjustment bolt, elongated covers are pivotally attached to the wall panel. However, this device fails to provide an office wall panel system that is easily extended to a new height. Therefore, a simple and more versatile panel extension mechanism is needed.

SUMMARY OF THE INVENTION

Briefly stated, the present invention is directed to a panel extension assembly for supporting an extension wall panel on top of a base wall panel. The panel extension has a channel member adapted to receive a substantially horizontally extending top surface of a base wall panel frame. The channel member has a pair of spaced side walls joined by a middle wall and is adapted to slide over the sides and rest on the top surface of the base wall panel frame. An extension member is attached to the channel member and extends upward therefrom. An extension wall panel is attached to the extension member thereby securing the extension wall panel on top of the base wall panel.

The present invention provides significant advantages over other wall panel assemblies. It is a primary object of this invention to provide a simple and more versatile panel extension capable of easily extending the height of an associated base wall panel assembly. Thus, office managers can now more readily configure open office spaces as desired. Also, the panel extension assembly provides for a secure and aesthetically pleasing wall panel assembly which does not leave open areas at the base of the assembly. This invention is more efficient and versatile than the prior art. This invention, together with attendant objects and advantages, will be best understood with reference to the detailed description below read in conjunction with the accompanying drawings.

DETAILED DESCRIPTION OF THE PREFERRED EMBODIMENTS

Figure 1:
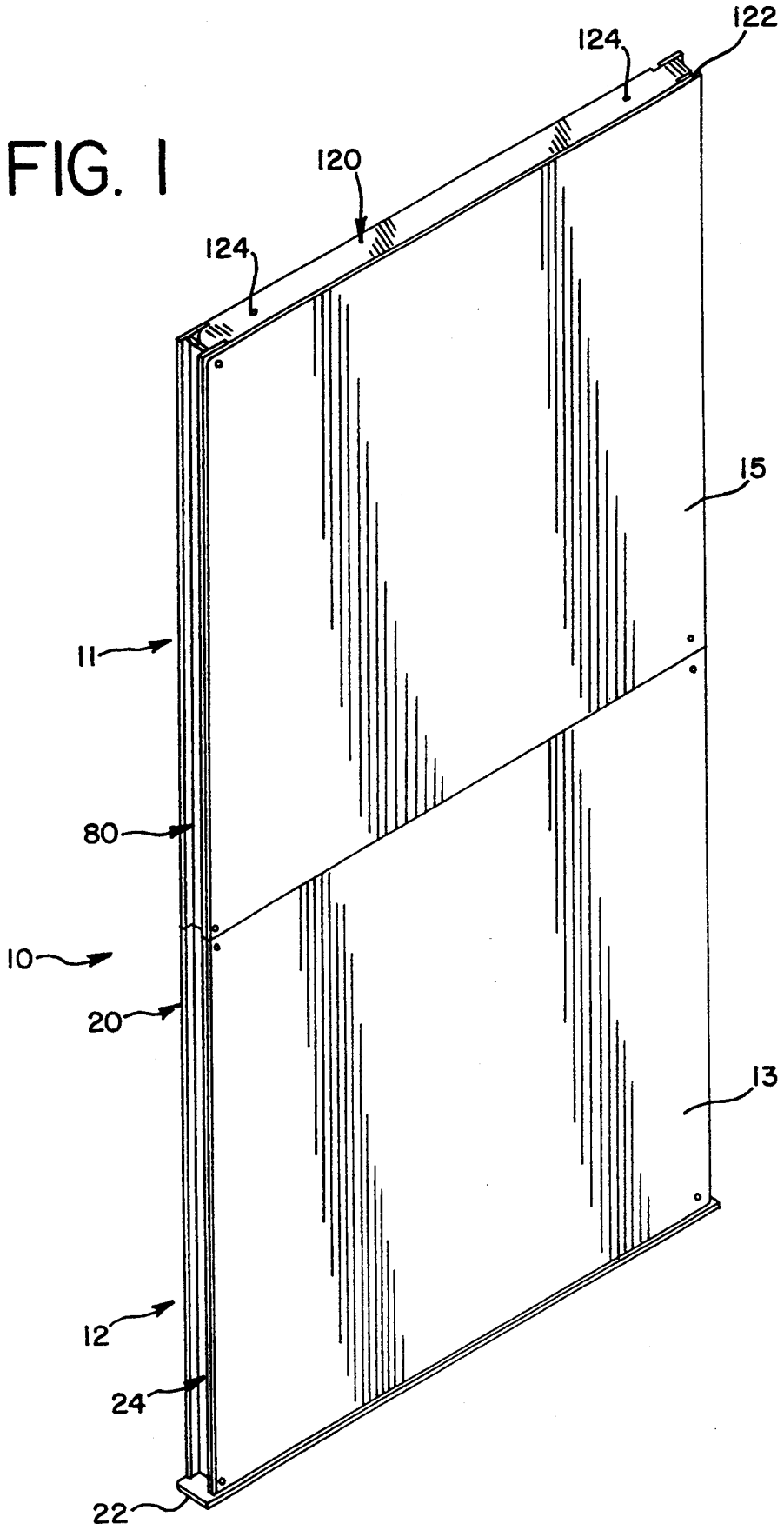
FIG. 1 is a perspective view of a preferred embodiment of the panel extension assembly of the present invention.
Figure 2:
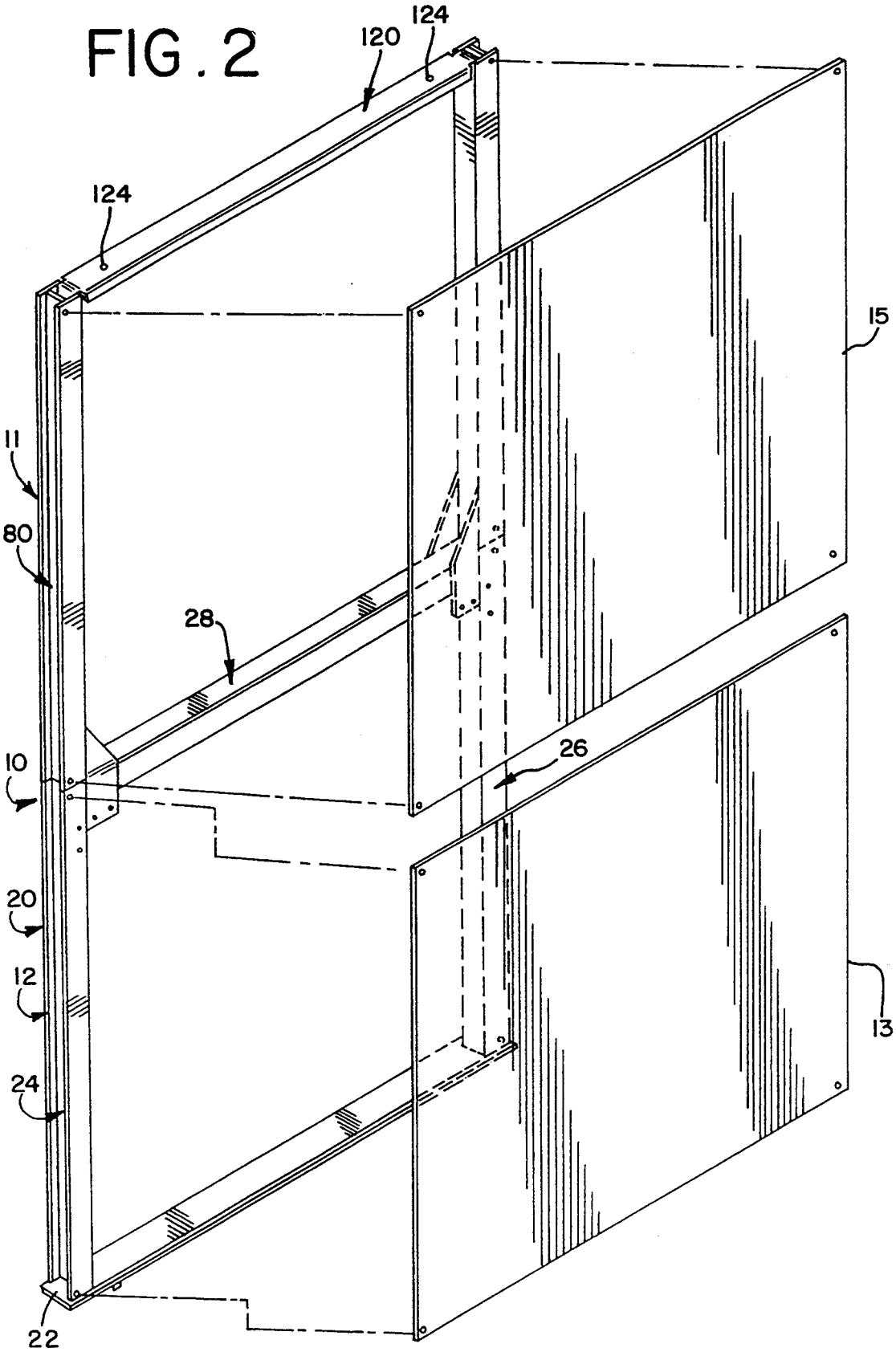
FIG. 2 is an exploded view of a preferred embodiment of the panel extension assembly of the present invention.

Referring to the drawings, FIGS. 1–5 show a preferred embodiment of the wall panel assembly 10 and panel extension assembly 11 of the present invention. In FIGS. 1–2, the wall panel assembly 10 is shown with a base wall panel assembly 12 having a base wall panel 13 and a panel extension assembly 12 with an extension wall panel 15. The panels 13 and 15 may be constructed from wood, plastic, metal or any other materials used in constructing modular walls. Similarly, the panels 13 and 15 may be provided with any external aesthetic characteristics that are desired.

The peripheral base wall panel frame 20 encasing the base wall panel 13 has a base support element 22, a first vertically extending side member 24, a second vertically extending side member 26 interconnected by a horizontally extending top member 28. The first side member 24, the second side member 26 and the top member 28 form a substantially horizontally extending top surface for the base frame 20. The vertically extending base wall panel 13 is attached to the first side member 24, the second side member 26 and the top member 28. The base wall panel 13 and base wall panel frame 20 may be those such as the Ethospace frame and panels manufactured by Herman Miller, Inc.

Figure 3:
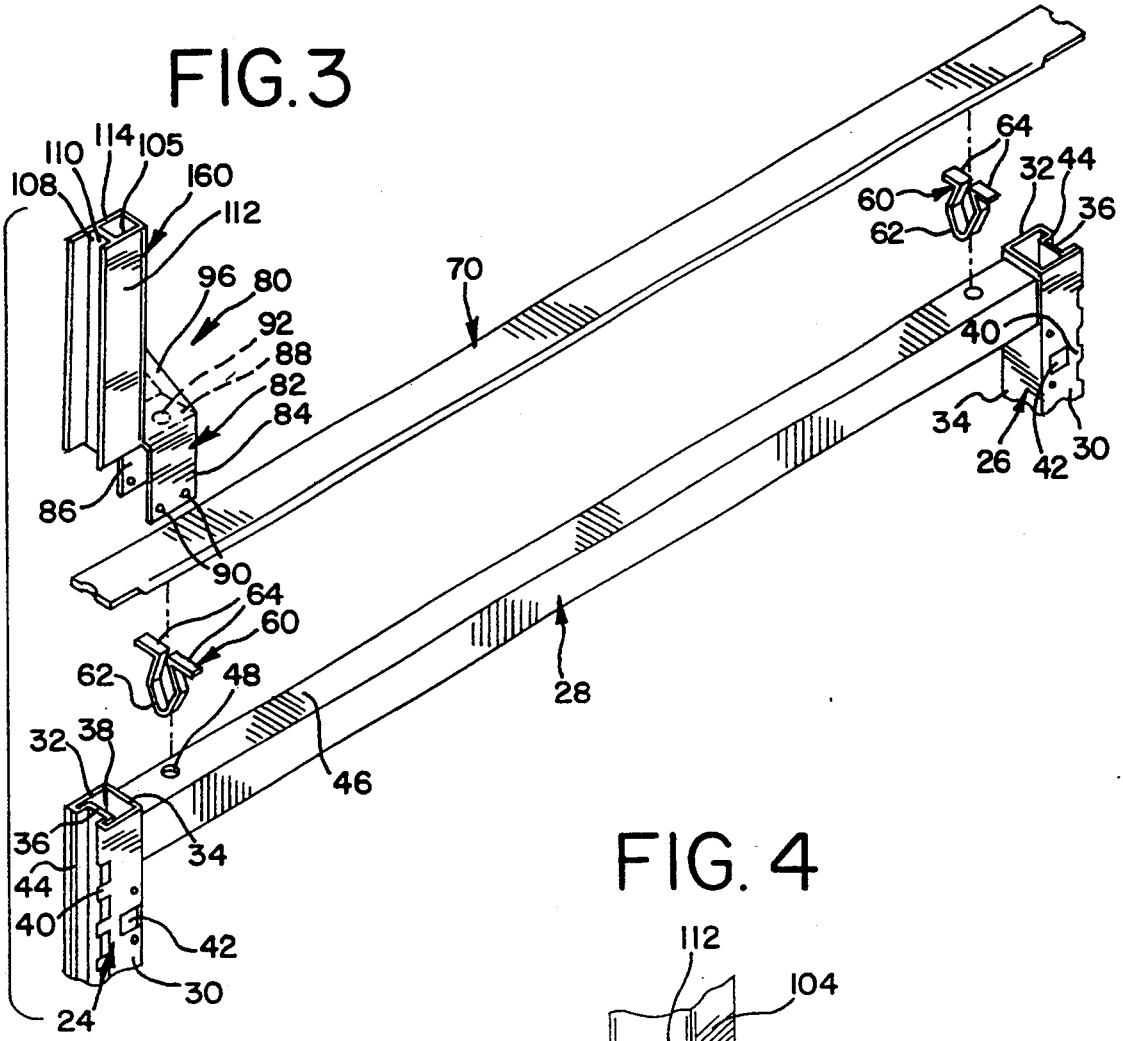
FIG. 3 is an exploded view of the panel extension assembly of the present invention in partial cross-section showing a panel extension and a base wall panel frame.

As best shown in FIG. 3, the first side member 24 and the second side member 26 have a front surface 30, a back surface 32, a first side surface 34 and a second side surface 36 defining a cavity 38 therein. In order to secure additional support panels, the side members 24 and 26 have a plurality of vertically aligned hook members 40 extending outward from the first side member 24 and the second side member 26 in order to mate with slots (not shown) in the side members of an adjacent wall panel assembly. Similarly, the first side member 24 and the second side member 26 have a series of slots which mate with the hook members 40 of an adjacent side member. A series of rectangular slots 42 are defined by the front surface 30 and the back surface 32 to provide a connection for a perpendicularly extending wall panel assembly. The side members 24 and 26 have a relatively narrow channel 44 extending upward from the bottom of the side member. The channel 44 is sized to securely mate with the edge of an adjacent wall panel thereby better securing the adjacent wall panel.

A horizontally extending top member 28 of the peripheral frame 20 is connected to the first side surface 34 of the first side member 24 and second side member 26. The top member 28 defines a cavity running therein. A first wall 46 of the top member 28 has apertures 48 sized to allow clips 60 to fit therein. The clips 60 have a resilient diamond shaped lower surface 62 extending from two projecting surfaces 64. The clips 60 are made from a resilient material such as plastic or the like. The resilient nature of the lower surface 62 of the clips 60 facilitates their insertion within the apertures 48 of the top member 28. The projecting surfaces 64 of the clips 60 engage a channel (not shown) in a cover member 70° The cover member 70 is attached to the top member 28 to provide an aesthetically pleasing top surface for the assembly.

Figure 4:
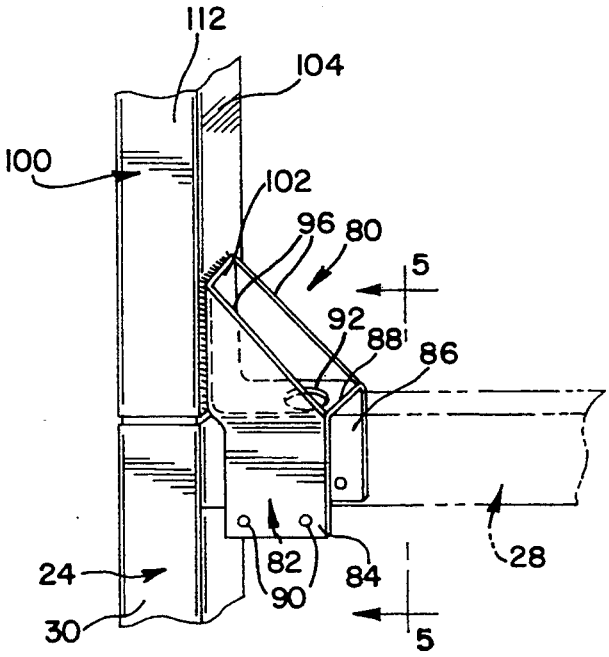
FIG. 4 is a fragmentary side view of a preferred embodiment showing a panel extension attached to a base wall panel frame.
Figure 5:
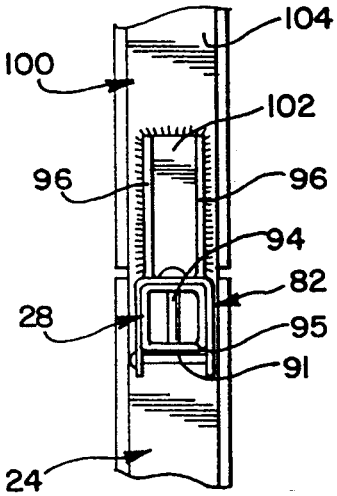
FIG. 5 is a fragmentary side view of a preferred embodiment taken along the lines 5—5 of FIG. 4 showing a panel extension attached to a base wall panel frame.

As best shown in FIGS. 3–5, a panel extension bracket 80 has a substantially U-shaped channel member 82 with a first side wall 84 and a second side wall 86 connected by a middle wall 88. The channel member 82 is sized to mate with the top member 28 of the base frame 20. Two apertures 90 are provided in each of the side walls 84 and 86 of the channel member 82. As shown in FIGS. 4 and 5, in order to secure the panel extension bracket 80, carriage bolts (one shown) 91 extend horizontally through apertures 90 of the first side wall 84 and through the apertures 90 of the second side wall 86. Nuts are attached to the threaded portions of the bolts 91 extending out the apertures 90 of the second side wall 86. Similarly, an aperture 92 is located in the middle wall 88 of the channel member 82 to further secure the panel extension bracket 80. A carriage bolt 94 extends downward through the aperture 92 and the top member 28 of the base frame 20. A nut is attached to the threaded portion of the bolt 94 extending out a bottom surface 95 of the top member 28 of the base wall panel frame 20.

The panel extension bracket 80 further includes a pair of spaced parallel side sections 96 extending upward from the channel member 82. The side sections 96 slope upwardly from the top member 28 of the base frame 20 to the extension member 100 thereby forming a substantially triangular shape. A vertically extending flange 102 runs between the two side sections 96 thereby connecting the side surfaces 96. The flange 102 is connected to the front wall 104 of the extension member 100.

The extension member 100 extends upward from the channel member 82 and directly above a side member of the base frame 20. The height of the frame member 100 may be adjusted to correspond with the height of an associated panel, although 32 inches is the preferred height. A vertically extending cavity 105 runs in the extension member 100. A J-shaped channel 108 runs up a first side wall 110 of the extension member 100. The channel 108 is sized to mate with an adjacent extension panel thereby better securing the adjacent extension panel. A front wall 112 and a back wall 114 of the extension 100 have apertures (not shown) for insertion of a fastening means such as a screw, bolt or the like that provides for a secure engagement between the extension wall panel 15 and the extension member 100.

As shown in FIGS. 1–2, a cap member 120 extends horizontally across the top surface 122 of the extension wall panel 15. The cap member 120 has an aperture 124 sized for the insertion of a fastening mechanism such as a screw, bolt or the like. The fastening mechanism serves to secure the cap member 120 against the extension member 100 and the extension wall panel 15. Second apertures 126 in the cap member 120 similarly serve to receive a fastening mechanism such as a screw, bolt or the like thereby securing the cap member 120 against the extension wall panel 15. The cap member 120 may be constructed from materials such as aluminum or the like.

The above described panel extension bracket 80 may be made from individual pieces joined together through welding or the like. For example, the upwardly extending flange 102 and the side sections 96 may be welded to the frame member 100. However, it is also within the scope of this invention that the panel extension bracket 80 may be made from a one piece construction such as that formed from an extrusion process or a die cast process. The panel extension bracket 80 and cap member 120 may be from materials such as aluminum or the like.

The embodiment described is illustrative and not restrictive. The scope of the invention is indicated by the claims rather than by the foregoing description. The invention may be embodied in other specific forms without departing from the spirit of the invention. Accordingly, all changes which come within the scope of the claims are intended to be embraced therein.

I claim:

1. A panel extension assembly comprising:

a channel member adapted to receive a substantially horizontally extending top surface of a base wall panel frame, said channel member having a pair of spaced side walls joined by a middle wall adapted to slide over sides of said base wall panel frame and rest on said top surface;

an extension member attached to said channel member and extending upward therefrom; and an extension wall panel having a front wall, a back wall and a vertically extending side edge, said side edge attached to said extension member such that said extension wall panel is adapted to be securely positioned on top of a base wall panel.

2. The panel extension assembly of claim 1 wherein said extension wall panel has a top corner and a bottom corner attached to said extension member.

3. The panel extension assembly of claim 2 further comprising a fastening means is adapted to secure said channel member to said top surface of said base wall panel frame.

4. The panel extension assembly of claim 3 wherein said middle wall of said channel member has an aperture through which said fastening means extends to secure said channel member to said top surface of said base wall panel frame.

5. The panel extension assembly of claim 2 wherein said channel member has an upwardly extending triangular shaped flange that connects said channel member to said extension member.

6. The panel extension assembly of claim 1 further comprising a cap member attached to a top of said extension member and extending to an adjacent extension member, said cap member framing a surface for said extension wall panel.

7. The panel extension assembly of claim 5 wherein the extension member has two spaced apart walls forming a vertically extending channel adapted to receive an adjoining extension wall panel.

8. A wall panel assembly for use with modular walls, said wall panel assembly comprising:

a base frame assembly having a base wall panel attached to a base wall panel frame having a substantially horizontally extending top surface;

a panel extension assembly comprising:

(i) a channel member adapted to slide over the sides and rest on top of said top surface of said base wall panel frame;

(ii) an extension member attached to said channel member and extending upward therefrom; and (iii) an extension wall panel attached to said extension member, said extension wall panel secured above said base wall panel whereby said wall panel assembly has a height at least as high as said base wall panel and said extension wall panel.

9. The wall panel assembly of claim 8 further comprising a pair of parallel spaced side flanges extending upward from said channel member to a front surface of said extension member.

10. The wall panel assembly of claim 9 wherein said side surfaces each has a triangular shape.

11. The wall panel assembly of claim 8 further comprising a cap member attached to a top of said extension member and extending along an upper surface of said extension wall panel to an adjacent extension member, said cap member framing an upper surface of said extension wall panel.

12. The wall panel assembly of claim 8 wherein said base wall panel and said extension wall panel are coplanar.

13. The wall panel assembly of claim 8 wherein said base frame assembly further comprises a support mechanism to secure said base frame assembly in a vertical orientation.

14. The wall panel assembly of claim 13 wherein said top surface of said base frame surface is formed from a first vertically extending side member and a second vertically extending side member interconnected by a horizontally extending top member.

15. A wall panel assembly for use with modular walls, said wall panel assembly comprising:

a base frame assembly having a base frame and a base wall panel attached to said base frame, said base frame having a substantially horizontally extending top surface having a first vertically extending side member and a second vertically extending side member interconnected by a horizontally extending top member;

a panel extension assembly comprising:

(i) a U-shaped member adapt&t to receive said top member of said base frame;

(ii) an extension member attached to said U-shaped member and extending upward therefrom;

(iii) an extension wall panel attached to said extension member, said extension wall panel secured above said base wall panel;

(iv) a fastening means that secures said extension wall panel to said extension member; and a cap member attached to a top of said extension member and extending to an adjacent extension member, said cap member framing a surface of said extension wall panel whereby said wall panel assembly has a height at least as high as said base wall panel and said extension wall panel.

* * * * *

UNITED STATES PATENT AND TRADEMARK OFFICE

CERTIFICATE OF CORRECTION

PATENT NO. :5,394,668
DATED :March 7, 1995
INVENTOR(S) :Bin H. Lim

It is certified that error appears in the above-indentified patent and that said Letters Patent is hereby corrected as shown below:

Column 6:

In claim 15, line 20, delete "adapt&t" and substitute --adapted--.

Signed and Sealed this

Twenty-first Day of May, 1996

Bruce Lehman

*Attest:*

BRUCE LEHMAN

*Attesting Officer*

*Commissioner of Patents and Trademarks*